US008145099B2

(12) United States Patent
Sato

(10) Patent No.: US 8,145,099 B2
(45) Date of Patent: Mar. 27, 2012

(54) IMAGE SCANNING UNIT AND IMAGE FORMING APPARATUS INCLUDING THE IMAGE SCANNING UNIT

(75) Inventor: Tetsuya Sato, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 442 days.

(21) Appl. No.: 12/331,743

(22) Filed: Dec. 10, 2008

(65) Prior Publication Data

US 2009/0154959 A1 Jun. 18, 2009

Related U.S. Application Data

(60) Provisional application No. 61/014,711, filed on Dec. 18, 2007.

(51) Int. Cl.
*G03G 15/04* (2006.01)

(52) U.S. Cl. ..... 399/211

(58) Field of Classification Search ..... 399/211
See application file for complete search history.

(56) References Cited

U.S. PATENT DOCUMENTS

| | | | | |
|---|---|---|---|---|
| 5,760,924 | A * | 6/1998 | Takahara et al. | 358/474 |
| 2002/0114645 | A1* | 8/2002 | Takahashi et al. | 399/211 |
| 2003/0039486 | A1* | 2/2003 | Bannai et al. | 399/211 |

FOREIGN PATENT DOCUMENTS

| | | | |
|---|---|---|---|
| JP | 4-136956 | | 5/1992 |
| JP | 4-252660 | | 9/1992 |
| JP | PH04-342357 | | 11/1992 |
| JP | 5-63916 | | 3/1993 |
| JP | 6-160990 | | 6/1994 |
| JP | 7-177297 | | 7/1995 |
| JP | 9-15745 | | 1/1997 |
| JP | 10322526 | A * | 12/1998 |
| JP | 11-187696 | | 7/1999 |
| JP | PH11-331487 | | 11/1999 |
| JP | 2000-66730 | | 3/2000 |
| JP | P2000-184127 | | 6/2000 |
| JP | 2001-166396 | | 6/2001 |
| JP | P2001-245098 | | 9/2001 |
| JP | 2002-218177 | | 8/2002 |
| JP | 203-75934 | | 3/2003 |
| JP | 2003-152963 | | 5/2003 |
| JP | 2003-167302 | | 6/2003 |
| JP | 2007-306054 | A | 11/2007 |

OTHER PUBLICATIONS

Machine translation of JP 10322526.*

Official Letter dated Nov. 11, 2010 from China Patent Office for corresponding Chinese Patent Application No. 200810186672.0.

Japanese Patent Application No. 2008-317266 Office Action dated Oct. 4, 2011 (English translation attached).

* cited by examiner

*Primary Examiner* — David Gray
*Assistant Examiner* — David Bolduc
(74) *Attorney, Agent, or Firm* — Patterson & Sheridan, LLP

(57) ABSTRACT

A pair of carriage rails are provided in parallel to each other in a casing. A carriage moves along the carriage rails. Both ends in a longitudinal direction of each of the carriage rails are fixed to the casing. A cross member functioning as a lens base is suspended between the carriage rails. Both ends of the cross member are fixed to a section between both the ends of the carriage rails. Intermediate sections in the longitudinal direction of the carriage rails are coupled to sidewalls of the casing via a coupling section.

16 Claims, 10 Drawing Sheets

IMAGE SCANNING UNIT AND IMAGE FORMING APPARATUS INCLUDING THE IMAGE SCANNING UNIT

CROSS-REFERENCE TO RELATED APPLICATION

This application is based upon and claims the benefit of priority from the prior U.S. Provisional Application No. 61/014,711, filed Dec. 18, 2007, the entire contents of which are incorporated herein by reference.

TECHNICAL FIELD

The present invention relates to an image scanning unit used in image forming apparatuses such as a copying machine, a printer, and a facsimile and an image forming apparatus including the image scanning unit.

BACKGROUND

An image forming apparatus such as a color copying machine or a printer includes an image scanning unit. The image scanning unit includes a casing as a scanner base, an exposure lamp provided below a transparent original placing table, an imaging optical system including a lens and a CCD sensor, and a mirror that reflects an image of an original to the imaging optical system.

In an example of the conventional image scanning unit, the casing includes a bottom wall, a pair of sidewalls, and a pair of end walls formed at both ends in a scanning direction. A lens base member is provided between the sidewalls. The imaging optical system is attached to the lens base member. The exposure lamp is mounted on a first carriage. The mirror is mounted on a second carriage. These carriages reciprocatingly move in the casing along carriage rails.

Both ends in a longitudinal direction of the carriage rails of the conventional image scanning unit are fixed to the end walls of the casing, respectively. Since the lens base member supports the imaging optical system in conjunction with the carriages, the lens base member is desirably fixed to the carriage rails without being directly fixed to the casing. The lens base member is fixed to an intermediate section in the longitudinal direction of the carriage rails. In this case, the weight of the lens base member and the imaging optical system is applied to the intermediate section in the longitudinal direction of the carriage rails. Therefore, if the carriages move along the carriage rails, a vibration mode may occur in the carriage rails. If such a vibration mode is transmitted to the imaging optical system, a quality of an image falls. In particular, a low-frequency vibration mode having a frequency lower than 100 Hz tends to cause an image failure. Therefore, in the conventional image scanning unit, in order to increase the frequency of the vibration mode, a vibration proof member such as a gel material or an insulator member has to be adopted, which causes an increase in cost.

In order to reduce the swing of the lens base member, there is also an idea to fix the intermediate section in the longitudinal direction of the carriage rails to the bottom wall of the casing. However, since there is a limit in shape accuracy of the bottom wall of the casing and the rigidity of the bottom wall is not so large, it is likely that a vibration mode that occurs in the bottom wall is transmitted to the lens base member via the carriage rails. Therefore, it is difficult to adopt the idea.

SUMMARY

It is an object of the present invention to provide an image scanning unit that can suppress a low-frequency vibration mode from occurring and an image forming apparatus including the image scanning unit.

According to an aspect of the present invention, there is provided an image scanning unit including: a casing having a pair of sidewalls; a pair of carriage rails provided in parallel to each other along the sidewalls; a cross member suspended between the pair of carriage rails; a carriage that moves in a longitudinal direction of the carriage rails; a driving mechanism that moves the carriage along the carriage rails; and a coupling section that fixes intermediate sections in the longitudinal direction of the carriage rails to the sidewalls of the casing.

With this configuration, when the carriages move in a scanning direction, it is possible to shift vibration modes, which occur in the carriage rails and the cross member, to a higher frequency and an image signal is improved.

According to another aspect of the present invention, there is provided an image forming apparatus including: the image scanning unit for scanning an image of an original; an image forming unit including a photoconductive member and a developing device; and an exposing device that outputs light to the photoconductive member. With this configuration, since an image signal of the image scanning unit is improved, it is possible to form a high-quality image.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

A first embodiment of the present invention is explained below with reference to FIGS. 1 to 12.

Figure 1:
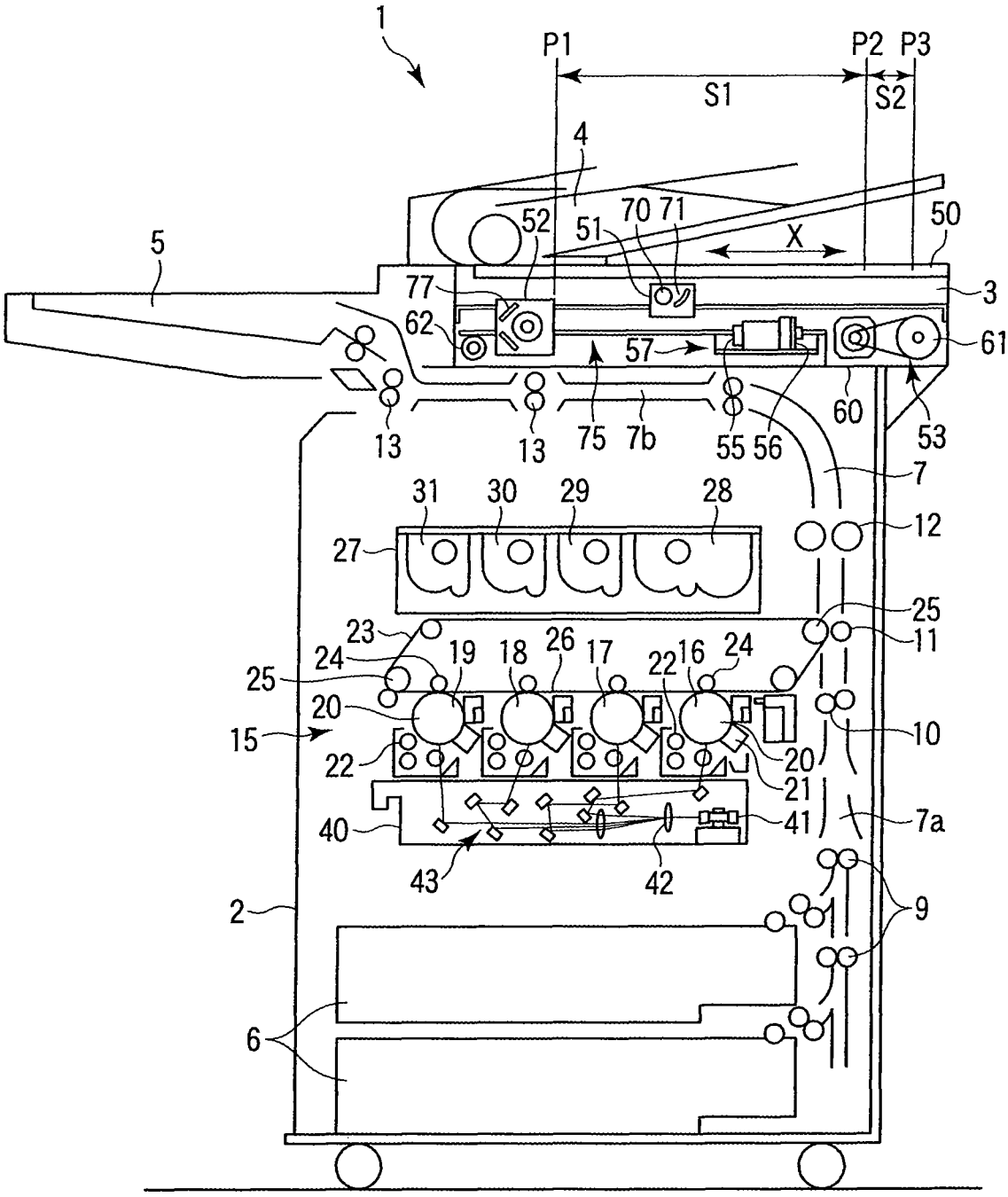
FIG. 1 is a schematic side view of the inside of an image forming apparatus including an image scanning unit according to a first embodiment of the present invention.
Figure 2:
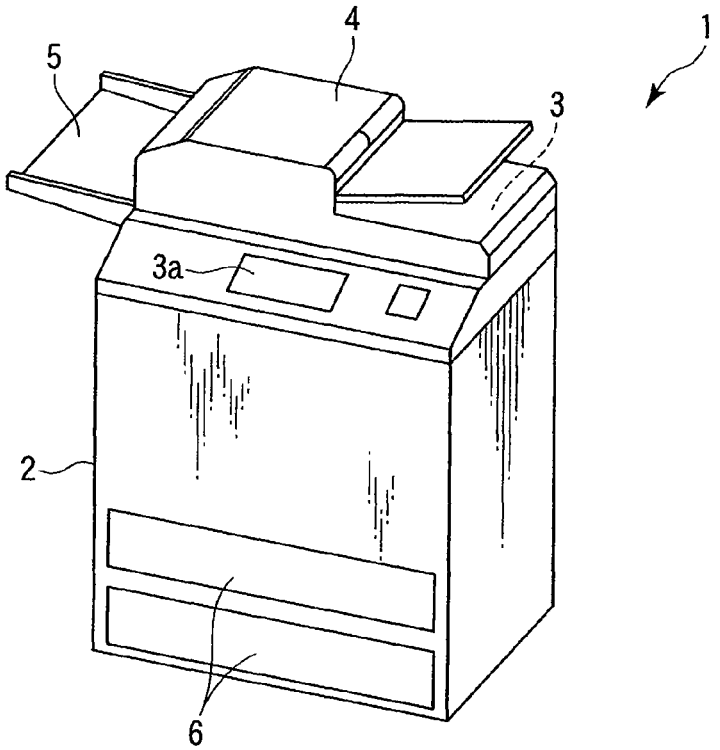
FIG. 2 is a perspective view of an example of an external appearance of the image forming apparatus shown in FIG. 1.

FIG. 1 is a schematic diagram of the inside of an image forming apparatus 1 such as a quadruple tandem color copying machine. FIG. 2 is a diagram of an example of an external appearance of the image forming apparatus 1. The image forming apparatus 1 includes an apparatus main body 2. An image scanning unit 3 which will be described later, an operation unit 3*a*, an auto document feeder 4, and a sheet discharging tray 5 are provided above the apparatus main body 2. The image scanning unit 3 scans an original. An arrow X in FIG. 1 indicates a scanning direction. The operation unit 3*a* is arranged on a front side of the image scanning unit 3. The opposite side of the operation unit 3*a* is a rear side of the image scanning unit 3.

Plural sheet feeding cassettes 6 are provided below the apparatus main body 2. The sheet feeding cassettes 6 are connected to the sheet discharging tray 5 via a conveying path 7. The conveying path 7 guides sheets stored in the sheet feeding cassettes 6 to the sheet discharging tray 5 one by one. The conveying path 7 has a first path 7*a* and a second path 7*b*. The first path 7*a* extends upward from the sheet feeding cassettes 6. The second path 7*b* extends horizontally from an upper end of the first path 7*a* toward the sheet discharging tray 5. Plural sheet feeding rollers 9, registration rollers 10, a transfer roller 11, and a fixing device 12 are provided in order from below in the first path 7*a*. Plural sheet discharging rollers 13 are provided in the second path 7*b*.

As shown in FIG. 1, an image forming unit 15 is provided in the middle stage of the apparatus main body 2. The image forming unit 15 includes a first image forming unit 16 for forming a black image, a second image forming unit 17 for forming a cyan image, a third image forming unit 18 for forming a magenta image, and a fourth image forming unit 19 for forming a yellow image. The first to fourth image forming units 16 to 19 are horizontally arranged in a row along a width direction of the apparatus main body 2.

Each of the first to fourth image forming units 16 to 19 includes a photoconductive drum 20, a charging device 21, a developing device 22, and an intermediate transfer roller 24. The charging device 21 uniformly charges an outer circumferential surface of the photoconductive drum 20. The developing device 22 develops, using a toner, an electrostatic latent image formed on the outer circumferential surface of the photoconductive drum 20. The intermediate transfer roller 24 transfers a toner image on the photoconductive drum 20 onto an intermediate transfer belt 23. The charging device 21, the developing device 22, and the intermediate transfer roller 24 are provided around the photoconductive drum 20.

The intermediate transfer belt 23 is wound in an endless shape around plural rollers 25. The intermediate transfer belt 23 is provided above the first to fourth image forming units 16 to 19. The intermediate transfer belt 23 has a horizontal traveling section 26. The horizontal traveling section 26 moves along a direction in which the first to fourth image forming units 16 to 19 are arranged. The horizontal traveling section 26 passes between the photoconductive drum 20 of each of the first to fourth image forming units 16 to 19 and the intermediate transfer roller 24. The intermediate transfer belt 23 is pressed against the transfer roller 11 on the conveying path 7 via one roller 25.

As shown in FIG. 1, a cartridge housing unit 27 is provided above the intermediate transfer belt 23. First to fourth toner cartridges 28, 29, 30, and 31 are housed in the cartridge housing unit 27. The first toner cartridge 28 supplies a black toner to the developing device 22 of the first image forming unit 16. The second toner cartridge 29 supplies a cyan toner to the developing device 22 of the second image forming unit 17. The third toner cartridge 30 supplies a magenta toner to the developing device 22 of the third image forming unit 18. The fourth toner cartridge 31 supplies a yellow toner to the developing device 22 of the fourth image forming unit 19.

An exposing device 40 is provided below the first to fourth image forming units 16 to 19. The exposing device 40 includes a polygon mirror 41, a deflection lens 42, and a mirror unit 43. The exposing device 40 irradiates laser beams corresponding to image information on the respective photoconductive drums 20 of the first to fourth image forming units 16 to 19. Electrostatic latent images corresponding to colors, which should be developed, are formed on the respective photoconductive drums 20 of the first to fourth image forming units 16 to 19 by the laser beams.

The electrostatic latent images formed on the respective photoconductive drums 20 of the first to fourth image forming units 16 to 19 are developed with the toners of the respective colors by the developing devices 22. Toner images of the four colors visualized in this way are sequentially transferred onto the intermediate transfer belt 23 via the intermediate transfer rollers 24 to be superimposed on the intermediate transfer belt 23.

A sheet is fed from one sheet feeding cassette 6 to the first path 7*a* of the conveying path 7. The sheet is guided to the position of the intermediate transfer belt 23 via the registration rollers 10. The toner images of the four colors superimposed on the intermediate transfer belt 23 are transferred onto the sheet via the transfer roller 11. A color image transferred onto the sheet is fixed on the sheet by the fixing device 12. The sheet having the color image fixed thereon is guided to the sheet discharging tray 5 through the second path 7*b* of the conveying path 7.

The image scanning unit 3 is explained below.

As shown in FIG. 1, the image scanning unit 3 is provided below an original placing table 50 made of a transparent glass plate. The image scanning unit 3 includes a first carriage 51, a second carriage 52, a driving mechanism 53 that moves the carriages 51 and 52 in the scanning direction (the direction indicated by the arrow X) in synchronization with each other, and an imaging optical system 57 including a lens 55 and a CCD sensor 56. The driving mechanism 53 includes a motor 60, a driving pulley 61, a driven pulley 62 (only a part thereof is shown), and a cable (not shown) such as a wire rope wound around the pulleys 61 and 62.

An exposure lamp 70 and a reflector 71 are mounted on the first carriage 51. The first carriage 51 moves in the horizontal direction along a guide structure 75. The first carriage 51 passes a terminal end P2 of a scanning effective region S1 from an initial position P1 shown in FIG. 1 and moves to a stroke end P3 of an idle traveling region S2 according to a size of the original. The first carriage 51 moves to the initial position P1 in a return path after scanning.

A mirror 77 is mounted on the second carriage 52. The second carriage 52 reciprocatingly moves in the scanning direction along the guide structure 75 in a range shorter than that of the first carriage 51. The moving speed of the second carriage 52 is lower than that of the first carriage 51.

Figure 3:
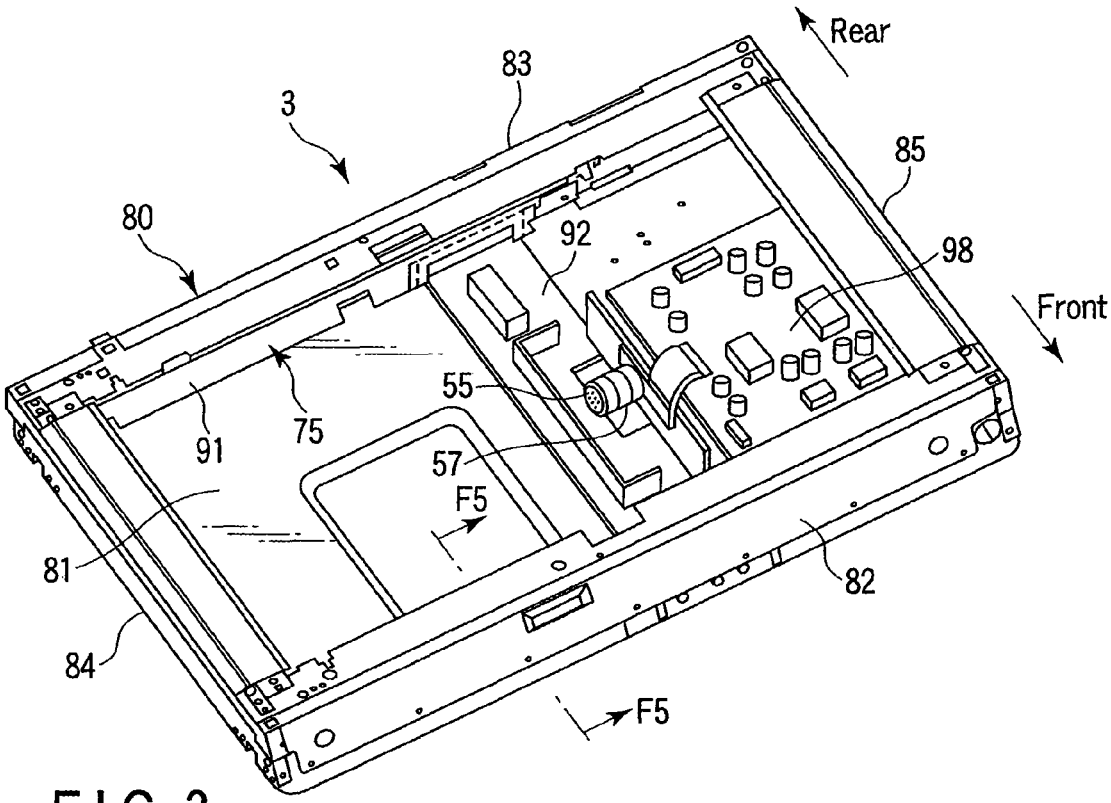
FIG. 3 is a perspective view of a part of the image scanning unit shown in FIG. 1.

FIG. 3 is a diagram of a part of the image scanning unit 3. The image scanning unit 3 includes a casing 80 as a scanner base. The casing 80 includes a bottom wall 81, a pair of sidewalls 82 and 83 rising from front and rear sides of the bottom wall 81, respectively, and a pair of end walls 84 and 85 rising from both ends in a left to right direction (the scanning direction) of the bottom wall 81, respectively. The bottom wall 81 and the sidewalls 82 and 83 are formed by pressing one metal plate.

Figure 4:
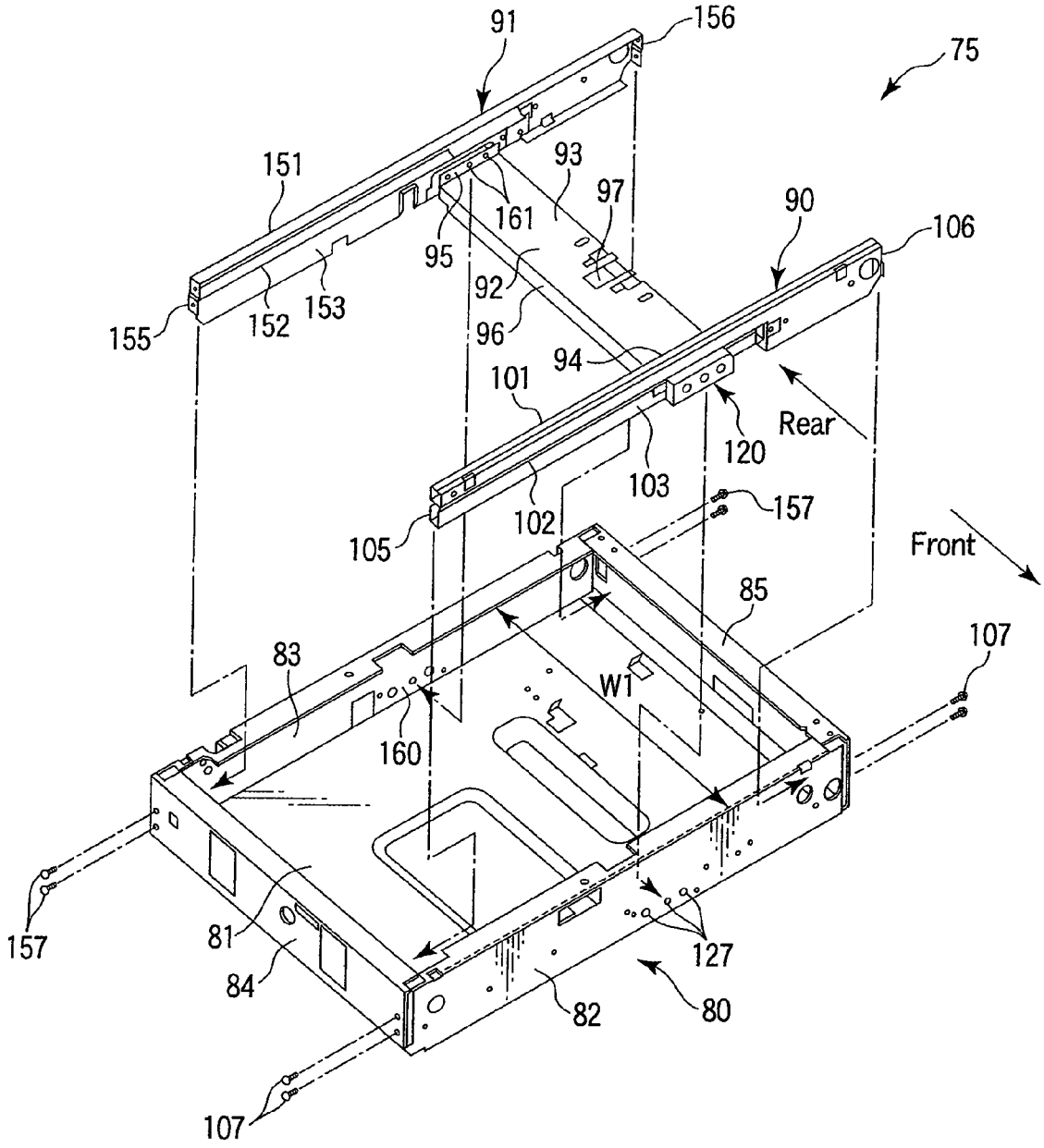
FIG. 4 is a disassembled perspective view of a casing and a guide structure of the image scanning unit shown in FIG. 1.

As shown in FIG. 4, the guide structure 75 is built in the inside of the casing 80. The guide structure 75 includes a front carriage rail 90 located on a front side of the casing 80, a rear carriage rail 91 located on a rear side of the casing 80, and a cross member 92 suspended between the carriage rails 90 and 91. The horizontally suspended cross member 92 functions as a lens base for supporting the imaging optical system 57 (shown in FIGS. 1 and 3).

The cross member 92 is formed by pressing a metal plate. The cross member 92 includes a main section 93 extending in the horizontal direction, a pair of attaching sections 94 and 95 formed by bending both ends in a longitudinal direction of the main section 93, and a pair of flanges 96 formed by bending both side edges of the main section 93. Bending rigidity and torsional rigidity of the cross member 92 are increased by the flanges 96.

A lens supporting section 97 is provided on an upper surface of the main section 93. The imaging optical system 57 (shown in FIGS. 1 and 3) including the lens 55 and the CCD sensor 56 is attached to the lens supporting section 97. The imaging optical system 57 is electrically connected to a control board 98 (shown in FIG. 3) for scanner control.

The front carriage rail 90 and the rear carriage rail 91 have shapes symmetrical to each other. The carriage rails 90 and 91 are provided in parallel to each other along the sidewalls 82 and 83 of the casing 80, respectively.

Figure 5:
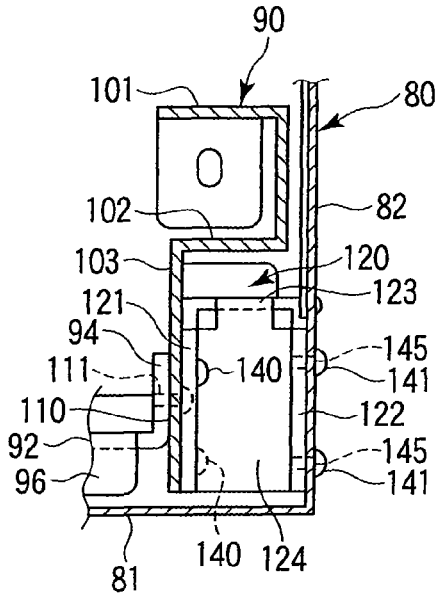
FIG. 5 is a sectional view of a part of the image scanning unit taken along an F5-F5 line in FIG. 3.

As shown in FIG. 5, the front carriage rail 90 includes a first rail section 101, a second rail section 102 formed on a lower side of the first rail section 101, and a vertical wall section 103 formed on a lower side of the second rail section 102. The rail sections 101 and 102 are parallel to each other and extend in the horizontal direction. The rail sections 101 and 102 and the vertical wall section 103 are integrally formed by, for example, pressing a sheet metal. Therefore, the front carriage rail 90 has bending rigidity and torsional rigidity larger than those of the sidewalls 82 of the casing 80.

The first rail section 101 has length enough for covering the scanning effective region S1 (shown in FIG. 1) corresponding to a largest original size and the idle traveling region S2. The first rail section 101 supports the first carriage 51. The first carriage 51 moves in the horizontal direction along the first rail section 101. On the other hand, the second rail section 102 supports the second carriage 52. The second carriage 52 moves in the horizontal direction along the second rail section 102. The second rail section 102 is shorter than the first rail section 101.

Figure 6:
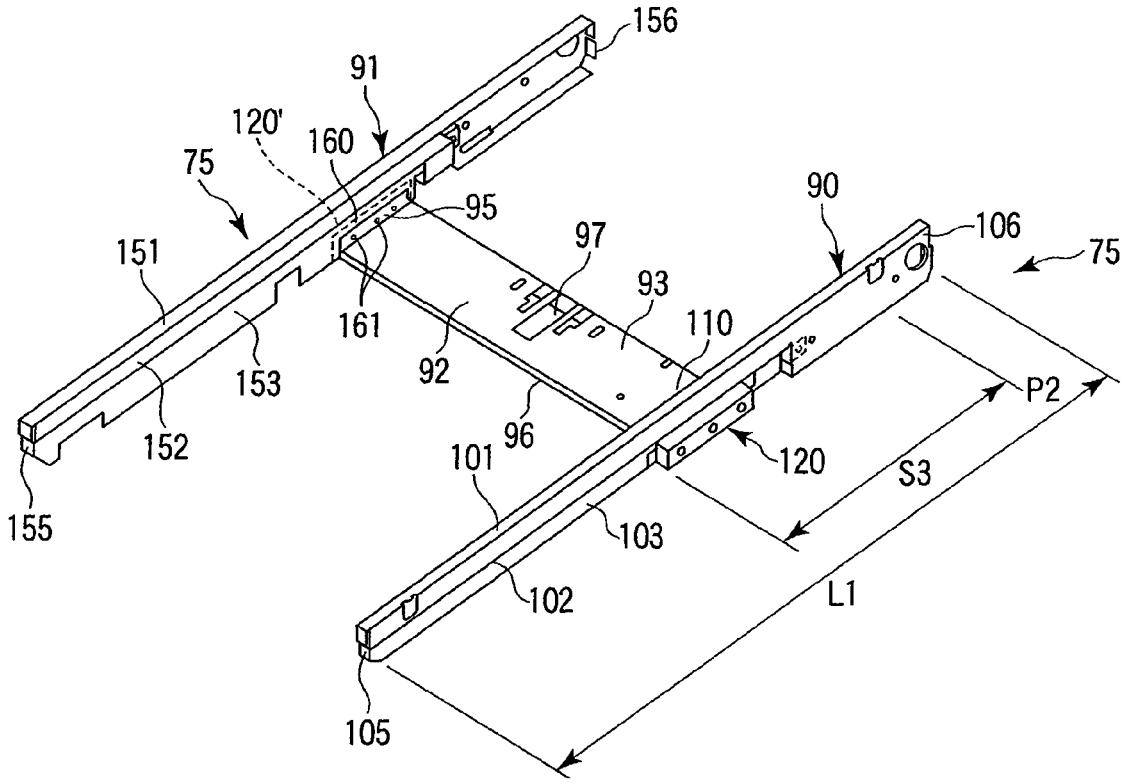
FIG. 6 is a perspective view of the guide structure of the image scanning unit shown in FIG. 1 viewed from above.

As shown in FIG. 6, attaching sections 105 and 106 are provided at both ends in a longitudinal direction of the carriage rail 90. As shown in FIG. 4, the attaching sections 105 and 106 are fixed to the end walls 84 and 85 of the casing 80 by fixing members 107 such as screws.

A fastening surface 110 (shown in FIG. 5) is formed in a part between both the ends of the carriage rail 90, i.e., an intermediate section in the longitudinal direction of the carriage rail 90. The fastening surface 110 is a part of the vertical wall section 103. The attaching section 94 of the cross member 92 is fixed to the fastening surface 110 by screw members 111.

Figure 7:
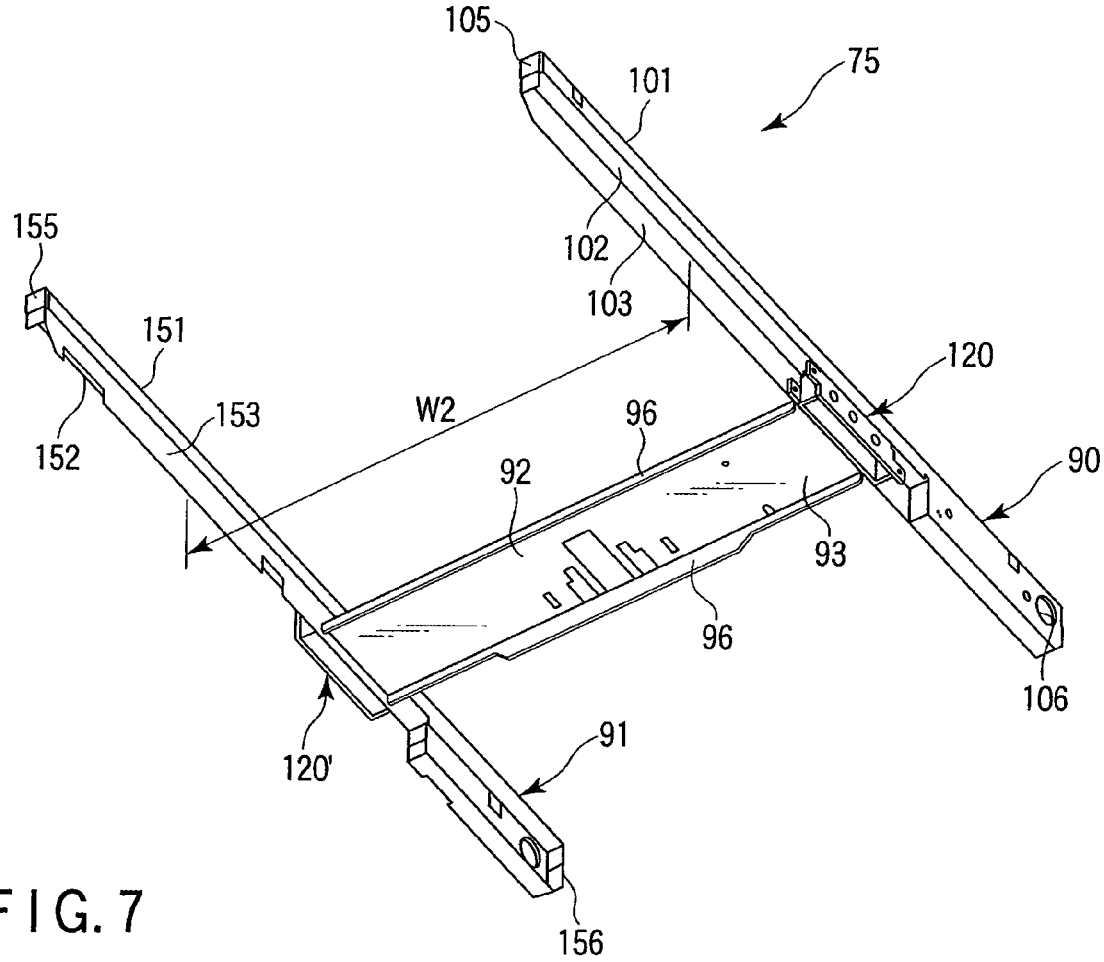
FIG. 7 is a perspective view of the guide structure of the image scanning unit shown in FIG. 1 viewed from below.
Figure 8:
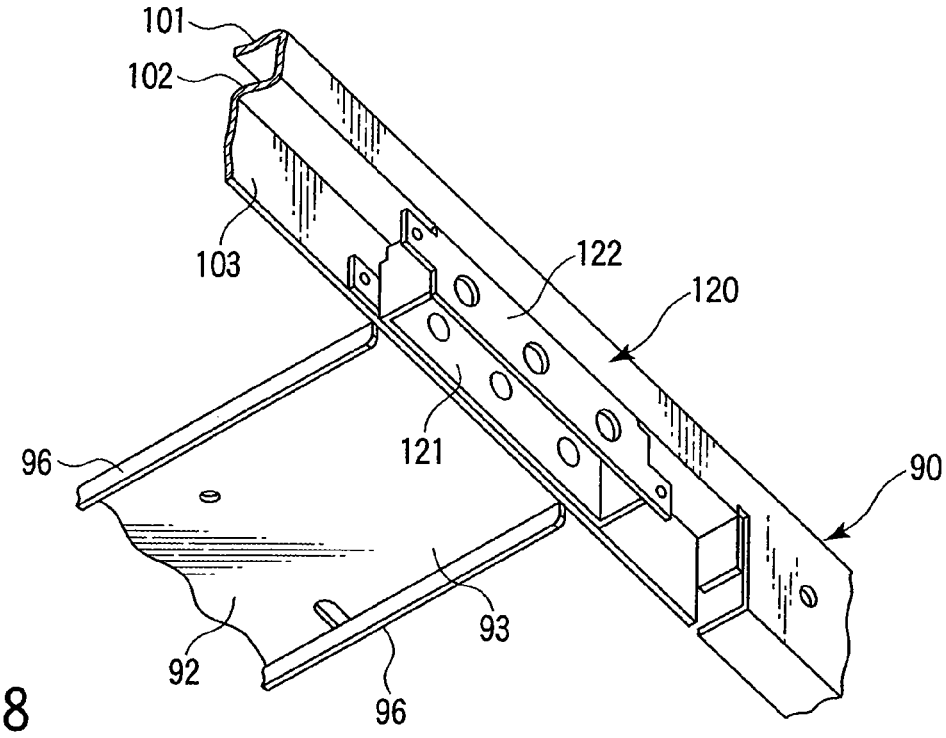
FIG. 8 is an enlarged perspective view of a part of the guide structure shown in FIG. 7.

As shown in FIGS. 4 to 8, a first spacer member 120 is attached to the carriage rail 90. FIG. 6 is a perspective view of the carriage rail 90 viewed from above. FIG. 7 is a perspective view of the carriage rail 90 viewed from below.

The spacer member 120 is provided in a range S3 from the flange 96 on the left side of the cross member 92 to the terminal end P2 of the scanning effective region S1 in the overall length L1 (shown in FIG. 6) of the carriage rail 90. In the case of this embodiment, the spacer member 120 is provided between the vertical wall section 103 of the carriage rail 90 and the sidewall 82 of the casing 80 in a position corresponding to the fastening surface 110 (shown in FIG. 5) of the carriage rail 90.

Figure 9:
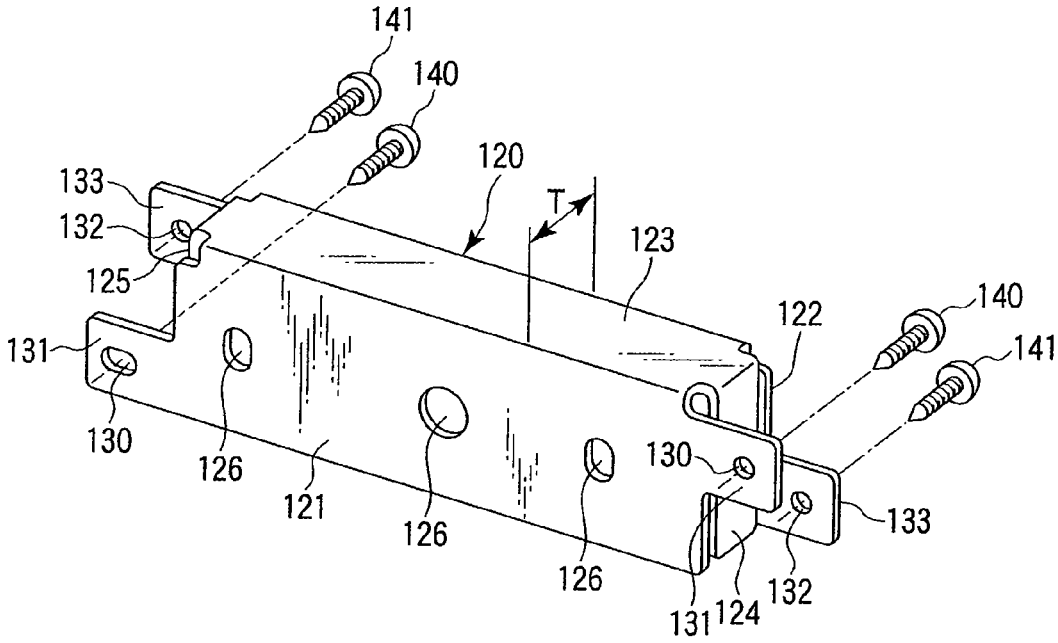
FIG. 9 is a perspective view of a spacer member used in the image scanning unit.

As shown in FIG. 9, the spacer member 120 is formed by bending a metal plate. The thickness of the metal plate as a material of the spacer member 120 is larger than the thickness of a metal plate as a material of the casing 80. The spacer member 120 includes first and second sidewall sections 121 and 122 parallel to each other, a coupling wall 123 that couples the sidewall sections 121 and 122, and end walls 124 and 125 formed by bending both ends in a longitudinal direction of the coupling wall 123. The sidewall sections 121 and 122 and the end walls 124 and 125 extend in an up to down direction. The coupling wall 123 extends in the horizontal direction.

In the sidewall sections 121 and 122 of the spacer member 120, holes 126 piercing through the sidewall sections 121 and 122 in the horizontal direction are formed in positions corresponding to the screw members 111 (shown in FIG. 5). In the sidewalls 82 of the casing 80, holes 127 (shown in FIG. 4) are formed in positions corresponding to the screw members 111. Therefore, the attaching section 94 of the cross member 92 is fixed to the carriage rail 90 by the screw members 111. The attaching section 94 of the cross member 92 can be fixed to the carriage rail 90 by inserting a tool (a screw driver) into the holes 126 and 127 from the outside of the sidewalls 82 of the casing 80.

Figure 10:
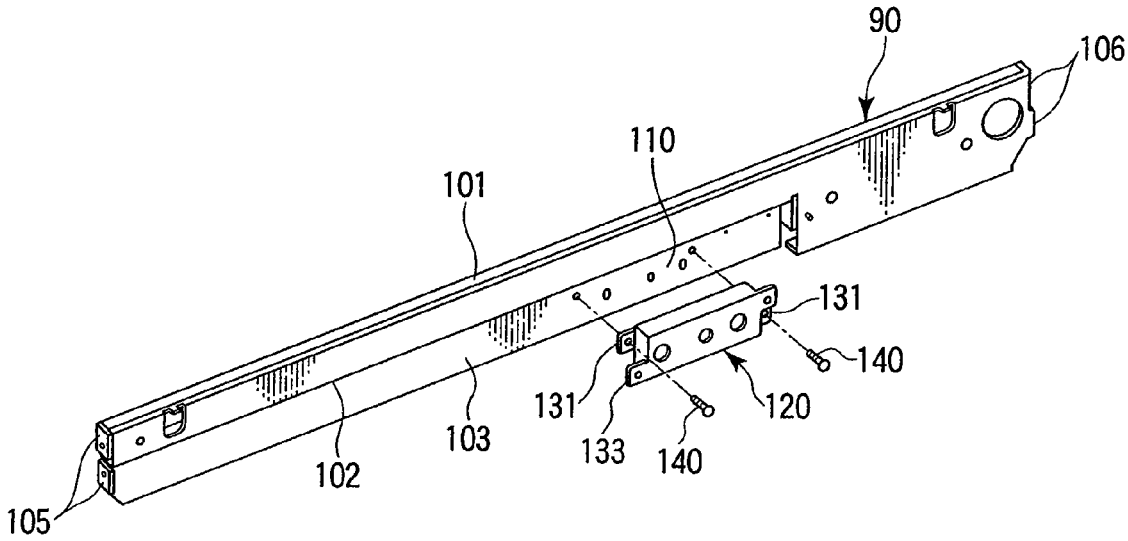
FIG. 10 is a perspective view of a front carriage rail and a spacer member of the image scanning unit.

A pair of attaching pieces 131 having holes 130 are provided in the first sidewall section 121 of the spacer member 120. A pair of attaching pieces 133 having holes 132 are provided in the second sidewall section 122. As shown in FIGS. 9 and 10, screw members 140 are inserted into the holes 130 of the attaching piece 131 and further screwed into holes of the carriage rail 90. In this way, the first sidewall section 121 of the spacer member 120 is fixed to the vertical wall section 103 of the carriage rail 90. In other words, the spacer member 120 functions as a coupling section for coupling the intermediate section in the longitudinal direction of the carriage rail 90 to the sidewall 82 of the casing 80.

As shown in FIG. 5, screw members 141 are inserted into holes 145 of the sidewall 82 of the casing 80 and further screwed into the holes 132 of the attaching pieces 133 of the spacer member 120. Consequently, the second sidewall section 122 of the spacer member 120 is fixed to the sidewall 82 of the casing 80.

The rear carriage rail 91 is configured the same as the front carriage rail 90. The rear carriage rail 91 includes a first rail section 151, a second rail section 152 formed on a lower side of the first rail section 151, and a vertical wall section 153 formed on a lower side of the second rail section 102. The rail sections 151 and 152 are parallel to each other and extend in the horizontal direction. The rail sections 151 and 152 and the vertical wall section 153 are integrally formed by, for example, pressing a sheet metal. Therefore, the carriage rail 91 has bending rigidity and torsional rigidity larger than those of the sidewall 83 of the casing 80.

The first rail section 151 has length enough for covering the scanning effective region S1 (shown in FIG. 1) corresponding to the largest original size and the idle traveling region S2. The first rail section 151 supports the first carriage 51. The first carriage 51 moves in the horizontal direction along the first rail section 151. On the other hand, the second rail section 152 supports the second carriage 52. The second carriage 52 moves in the horizontal direction along the second rail section 152. The second rail section 152 is shorter than the first rail section 151.

Attaching sections 155 and 156 are provided at both ends in a longitudinal direction of the carriage rail 91. As shown in FIG. 4, the attaching sections 155 and 156 are fixed to the end walls 84 and 85 of the casing 80 by fixing members 157 such as screws.

A fastening surface 160 (shown in FIGS. 4 and 6) is formed in a part between both the ends of the carriage rail 91, i.e., an intermediate section in the longitudinal direction of the carriage rail 91. The fastening surface 160 is a part of the vertical wall section 153. The attaching section 95 of the cross member 92 is fixed to the fastening surface 160 by screw members 161.

Figure 11:
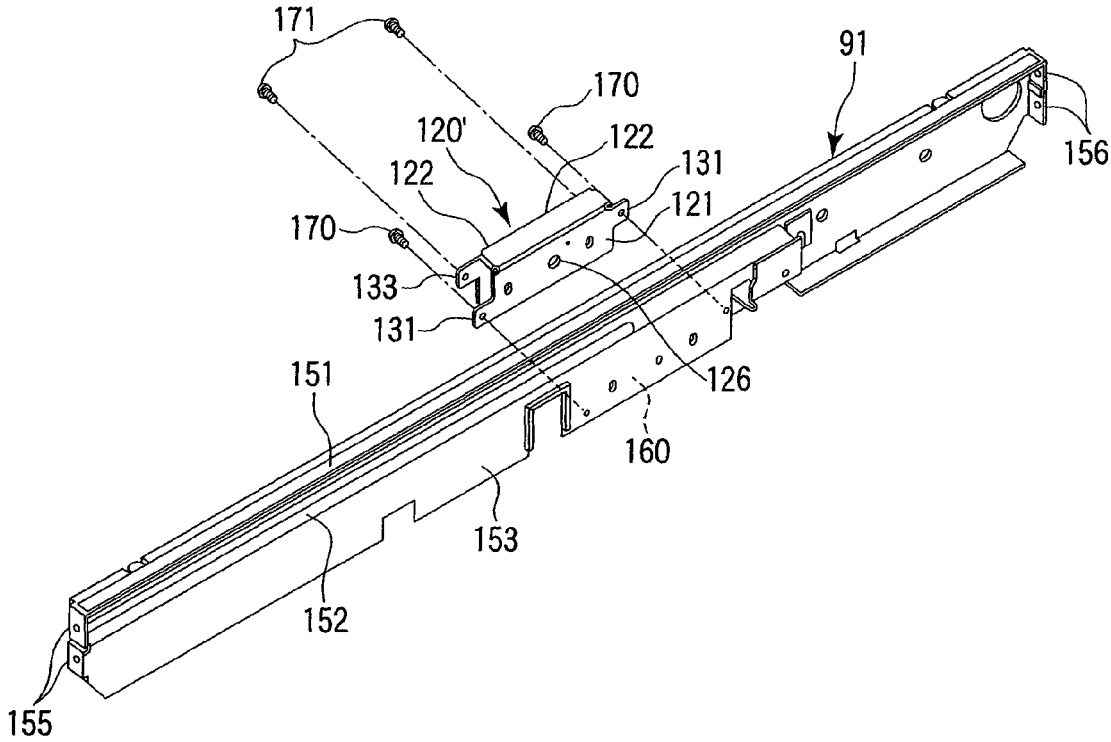
FIG. 11 is a perspective view of a rear carriage rail and a spacer member of the image scanning unit.

As shown in FIG. 11, a second spacer member 120' is attached to the carriage rail 91. FIG. 11 is a perspective view of the carriage rail 91 viewed from above. The spacer member 120' is formed in the same manner as the spacer member 120. In the case of this embodiment, the spacer member 120' is provided between the vertical wall section 153 of the carriage rail 91 and the sidewall 83 of the casing 80 in a position corresponding to the fastening surface 160.

Holes 126 are formed in positions corresponding to the screw members 161 in sidewall sections 121 and 122 of the spacer member 120'. Not shown holes are formed in positions corresponding to the screw members 161 (shown in FIGS. 4 and 6) in the sidewall 83 of the casing 80. Therefore, the attaching section 95 of the cross member 92 can be fixed to the carriage rail 91 by the screw members 161 from the outer side of the sidewall 83 of the casing 80.

As shown in FIG. 11, the first sidewall section 121 of the spacer member 120' is fixed to the vertical wall section 153 of the carriage rail 91 by screw members 170. The second sidewall section 122 of the spacer member 120' is fixed to the sidewall 83 of the casing 80 by screw members 171. The spacer member 120' functions as a coupling section for coupling the intermediate section in the longitudinal direction of the carriage rail 91 to the sidewall 83 of the casing 80.

The distance between surfaces on inner sides of the sidewalls 82 and 83 of the casing 80 is represented as W1 (shown in FIG. 4). The distance between surfaces on outer sides of the vertical wall sections 103 and 153 of the carriage rails 90 and 91 coupled by the cross member 92 is represented as W2 (shown in FIG. 7). The thickness in a front to back direction of each of the spacer members 120 and 120' is represented as T (shown in FIG. 9). In the case of this embodiment, the total thickness 2×T of the two spacer members 120 and 120' is set equal to a difference between the distance W1 and the distance W2 (W1−W2). Therefore, the first spacer member 120 can be closely attached between one sidewall 82 and the carriage rail 90. The second spacer member 120' can be closely attached between the other sidewall 83 and the carriage rail 91.

Operations of the image forming apparatus 1 having the configuration are explained below.

A user places an original on the original placing table 50 and operates a switch of the operation unit 3*a* to start scanning of the original. The first carriage 51 and the second carriage 52 are moved in the scanning direction by the driving mechanism 53 of the image scanning unit 3. The first carriage 51 moves to the stroke end P3 in the scanning effective region S1 by a distance corresponding to a size of the original at speed higher than that of the second carriage 52. When the first carriage 51 passes the scanning effective region S1, the original is illuminated by the exposure lamp 70 and an image of the original is made incident on the lens 55. The image made incident on the lens 55 is converted into an electric signal and outputted to the control board 98 by the CCD sensor 56.

An analog signal of the image outputted to the control board 98 is sent to an image processing circuit (not shown) and digitized. Image lights corresponding to respective colors of image data are outputted from the exposing device 40 to the photoconductive drums 20 of the respective image forming units 16 to 19. Consequently, electrostatic latent images corresponding to the respective colors of the image data are formed on the photoconductive drums 20 of the image forming units 16 to 19.

The electrostatic latent images formed on the photoconductive drums 20 are developed with toners of the respective colors in the developing devices 22, which store developers of the colors corresponding to the image data, and visualized. Toner images formed on the photoconductive drums 20 are transferred onto sheets (not shown), which are extracted one by one by the sheet feeding rollers 9, by the transfer belt 23 and the transfer rollers 24. The toner images transferred onto the sheet is fixed to the sheet by the fixing device 12. The sheet is discharged to the sheet discharging tray 5.

In the image scanning unit 3 according to this embodiment, the imaging optical system 57 is attached to the cross member 92. The attaching sections 94 and 95 provided at both ends of the cross member 92 are respectively fixed to the carriage rails 90 and 91 via the fastening surfaces 110 and 160. The carriage rails 90 and 91 are respectively fixed to the sidewalls 82 and 83 of the casing 80 via the spacer members 120 and 120' in portions corresponding to the fastening surfaces 110 and 160.

As explained above, in this embodiment, the intermediate sections in the longitudinal direction of the carriage rails 90 and 91, which support the horizontally suspended cross member 92, are coupled to the sidewalls 82 and 83 of the casing 80 via the spacer members 120 and 120'. The strength of the coupling sections is increased by the spacer members 120 and 120' having high rigidity. Therefore, when the carriages 51 and 52 move in the scanning direction along the carriage rails 90 and 91, the carriage rails 90 and 91 are prevented from swinging and twisting. Therefore, the cross member 92, which supports the imaging optical system 57, is also prevented from swinging and twisting in an up to down direction.

In the conventional image scanning unit, when the first carriage passes the imaging optical system and moves to the terminal end of the scanning effective region, a low-frequency vibration mode tends to appear in the carriage rails. However, in this embodiment, the intermediate sections in the longitudinal direction of the carriage rails 90 and 91 including the fastening surfaces 110 and 160 of the cross member 92 in the overall length of the carriage rails 90 and 91 are respectively fixed to the sidewalls 82 and 83 of the casing 80 via the spacer members 120 and 120' functioning as the coupling sections. Therefore, when the first carriage 51 passes near the imaging optical system 57 and moves to the terminal end P2 of the scanning effective region S1, it is possible to prevent a low-frequency vibration mode from appearing in the carriage rails 90 and 91 and the cross member 92 and improve an image quality.

Figure 12:
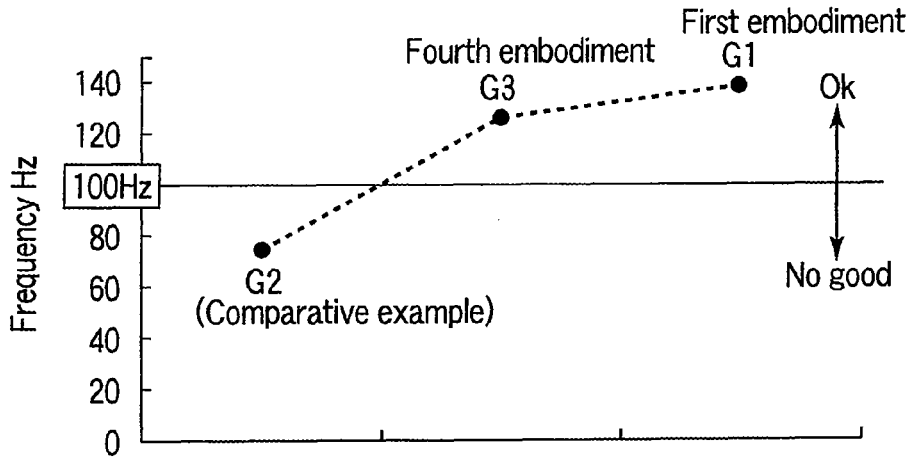
FIG. 12 is a diagram of frequencies of a vibration mode of the image scanning unit and a vibration mode of a comparative example.

G1 in FIG. 12 indicates a frequency of a vibration mode of the image scanning unit 3 according to this embodiment. G2 in FIG. 12 indicates a frequency of a vibration mode of a comparative example. In the comparative example, only both ends of carriage rails are fixed to a casing. In the case of the comparative example, since a vibration mode occurs near 75 Hz, an image quality is not high. On the other hand, in the image scanning unit 3 according to this embodiment, the swing of the carriage rails 90 and 91 and the cross member 92 is suppressed. As a result, a vibration mode can be raised to near 140 Hz, amplitude decreases, and a satisfactory image signal can be obtained.

Figure 13:
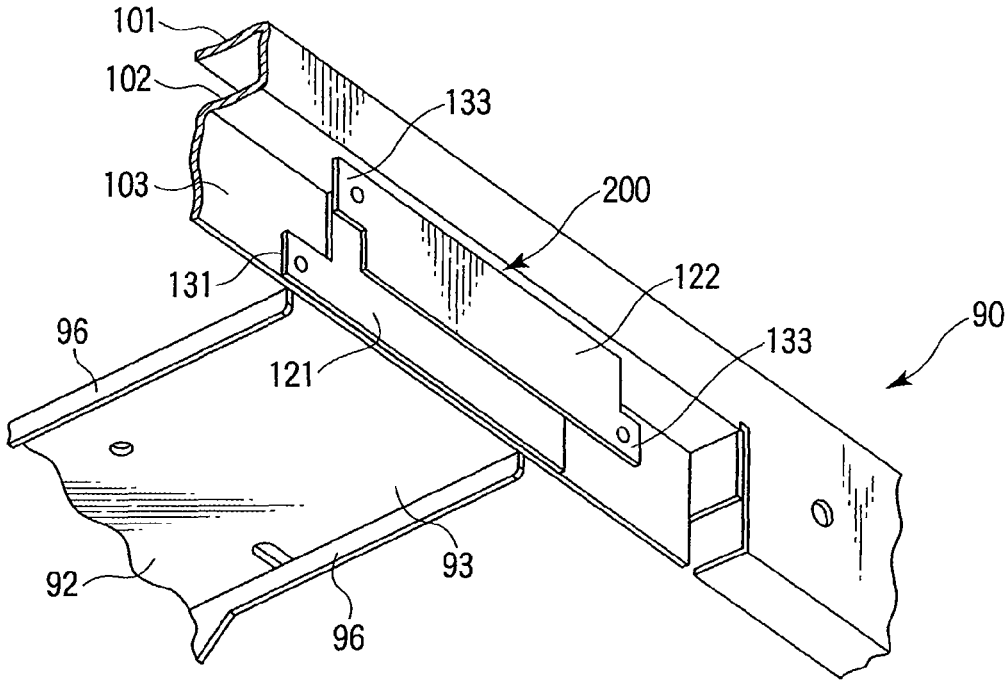
FIG. 13 is a perspective view of a part of an image scanning unit according to a second embodiment of the present invention.
Figure 14:
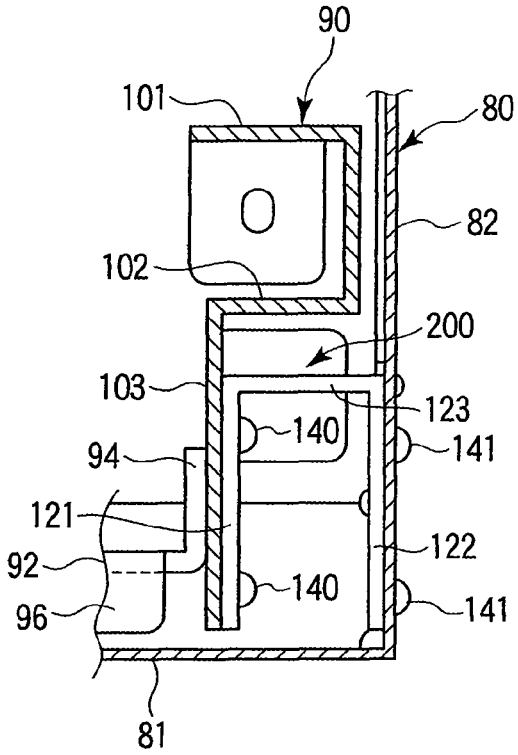
FIG. 14 is a sectional view of a part of the image scanning unit shown in FIG. 13.

FIGS. 13 and 14 are diagrams of a spacer member 200 according to a second embodiment of the present invention. The spacer member 200 is different from the spacer member 120 explained in the first embodiment in that the spacer member 200 does not include the end walls 124 and 125. Otherwise, the spacer member 200 is configured the same as the spacer member 120 of the image scanning unit 3 according to the first embodiment. Therefore, the same components are denoted by the same reference numerals and explanation of the components is omitted.

Figure 15:
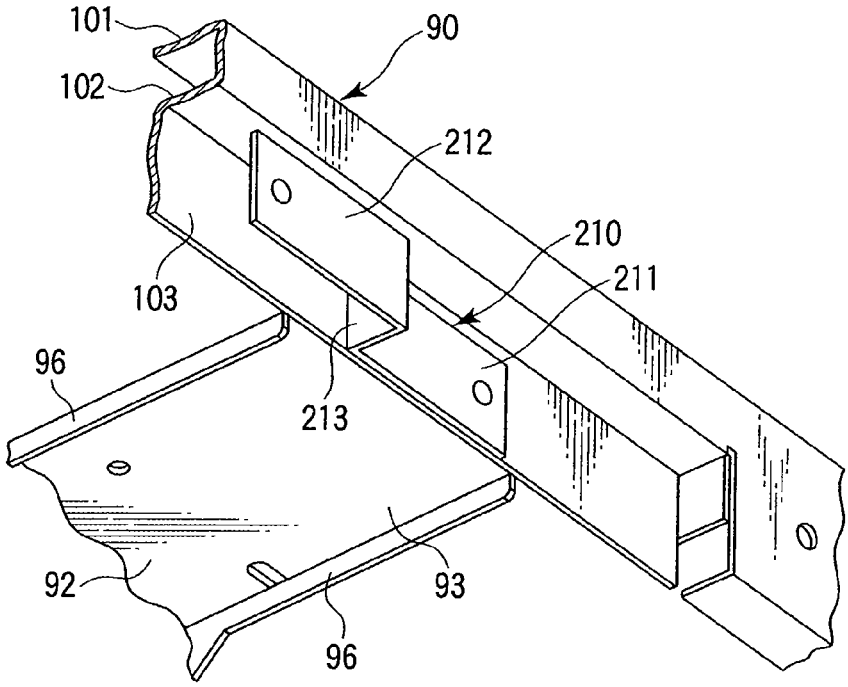
FIG. 15 is a perspective view of a part of an image scanning unit according to a third embodiment of the present invention.
Figure 16:
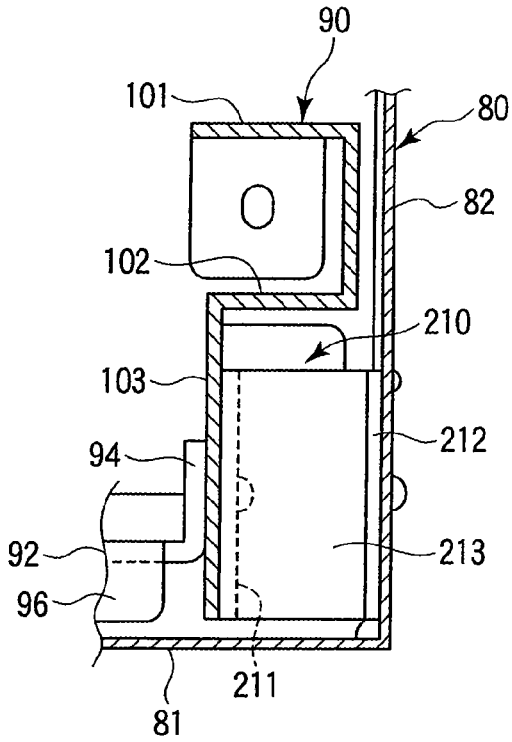
FIG. 16 is a sectional view of a part of the image scanning unit shown in FIG. 15.

FIGS. 15 and 16 are diagrams of a spacer member 210 according to a third embodiment of the present invention. The spacer member 210 includes a first arm section 211 fixed to the carriage rail 90, a second arm section 212 fixed to the sidewall 82 of the casing 80, and a connecting section 213 that connects the arm sections 211 and 212. The spacer member 210 is formed in a substantial Z shape viewed from above. Otherwise, the spacer member 210 is configured the same as the spacer member 120 of the image scanning unit 3 according to the first embodiment. Therefore, the same components are denoted by the same reference numerals and explanation of the components is omitted.

Figure 17:
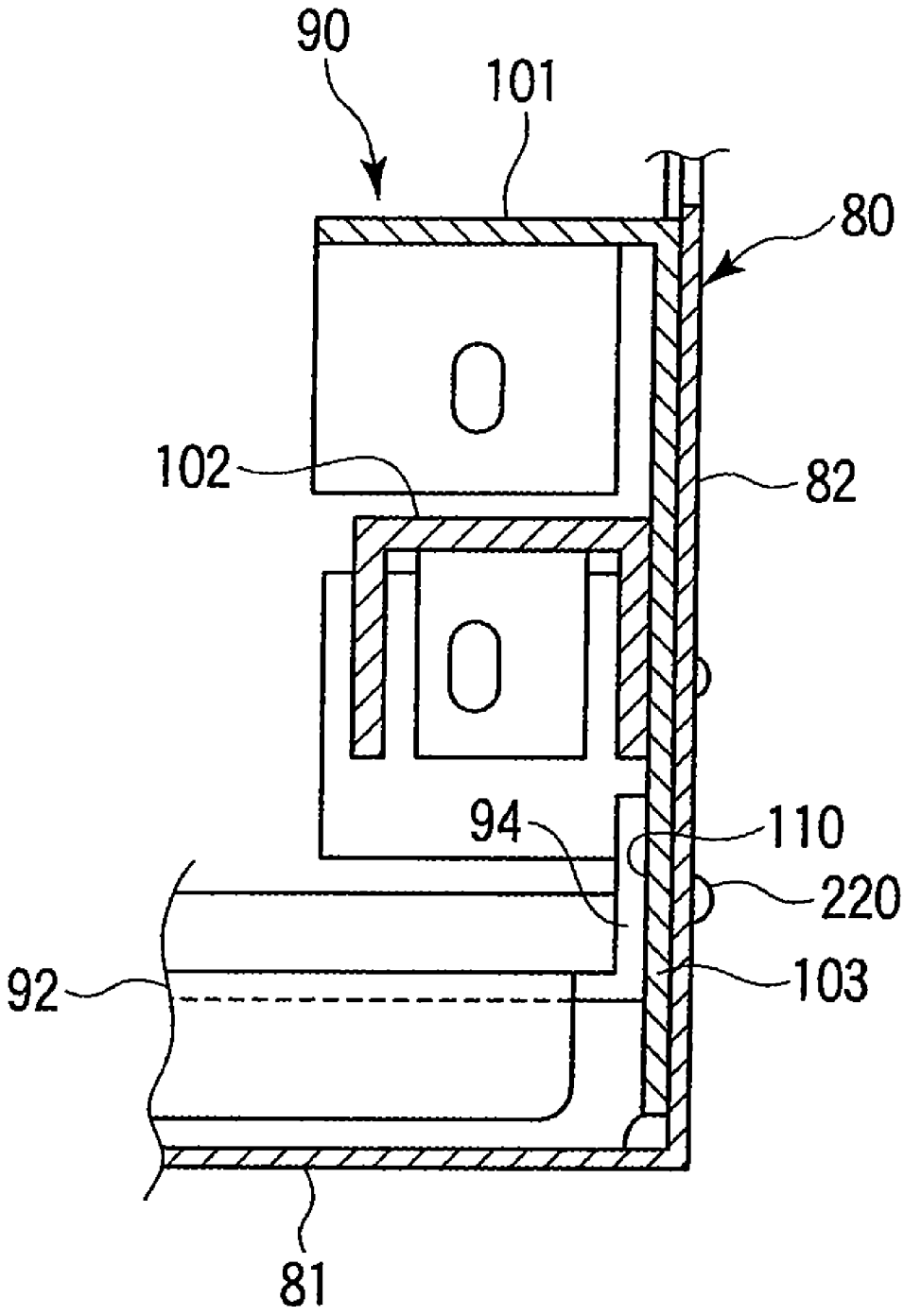
FIG. 17 is a sectional view of a part of an image scanning unit according to a fourth embodiment of the present invention.

FIG. 17 is a diagram of a part of an image scanning unit according to a fourth embodiment of the present invention. In the case of this embodiment, the intermediate section in the longitudinal direction of the carriage rail 90 is directly fixed to the sidewall 82 of the casing 80 by fixing members 220 (only a part thereof is shown) such as screws without using a spacer member. In other words, in the case of this embodiment, a section coupled to the sidewall 82 of the casing 80 in a part of the carriage rail 90 by the fixing members 220 functions as a coupling section. The coupling section is provided in a position corresponding to the fastening surface 110 of the carriage rail 90. A vibration mode in this embodiment is indicated by G3 in FIG. 12. In this embodiment, as in the first embodiment, the vibration mode can exceed 100 Hz and an image quality is improved. A material and a shape of the spacer member are not limited to those in the embodiments explained above. For example, a spacer member made of a block of synthetic resin may be used.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image scanning unit comprising:

a casing having a pair of sidewalls;

a pair of carriage rails provided in parallel to each other along the sidewalls, each of the carriage rails including first and second rail sections parallel to each other and a vertical wall formed on a lower side of the second rail section;

a cross member suspended between the pair of carriage rails;

a carriage that moves in a longitudinal direction of the carriage rails;

a driving mechanism that moves the carriage along the carriage rails; and a coupling section that couples intermediate sections of the carriage rails to the sidewalls of the casing, the coupling section including a spacer member which is held between the vertical wall of the carriage rail and the sidewall of the casing.

2. The unit according to claim 1, wherein a fastening surface for fixing the cross member is provided in the intermediate sections in the longitudinal direction of the carriage rails, and the coupling section is provided in a position corresponding to the fastening surface.

3. The unit according to claim 1, wherein the spacer member includes:

a first sidewall section fixed to the carriage rails in a closely attached state;

a second sidewall section fixed to the sidewalls of the casing in a closely attached state; and a coupling wall that connects the first and second sidewall sections.

4. The unit according to claim 1, wherein the spacer member includes:

a first arm section fixed to the carriage rails;

a second arm section fixed to the sidewalls of the casing; and a connecting section that connects the first and second arm sections, and the spacer member is formed in a substantially Z shape viewed from above.

5. The unit according to claim 1, wherein when a distance between surfaces on inner sides of the pair of sidewalls of the casing is represented as W1, a distance between surfaces on outer sides of the pair of carriage rails coupled by the cross member is represented as W2, and thickness of the spacer member is represented as T, thickness 2×T equivalent to a pair of the spacer members is equal to a difference between the distance W1 and the distance W2, one spacer member is closely attached to one carriage rail and one sidewall of the casing, and the other spacer member is closely attached to the other carriage rail and the other sidewall of the casing.

6. The unit according to claim 1, wherein an imaging optical system including a lens and a CCD sensor is mounted on the cross member, and the spacer member is provided in a range from the imaging optical system to a terminal end of a scanning effective region in a region in which the carriage moves in a scanning direction.

7. The unit according to claim 1, wherein, in the coupling section, the intermediate sections in the longitudinal direction of the carriage rails and the sidewalls of the casing are directly fixed to each other by a fixing member.

8. The unit according to claim 7, wherein an imaging optical system including a lens and a CCD sensor is mounted on the cross member, and the coupling section is provided in a range from the imaging optical system to a terminal end of a scanning effective region in a region in which the carriage moves in a scanning direction.

9. An image forming apparatus comprising:

an image scanning unit that scans an image of an original;

an image forming unit including a photoconductive member and a developing device; and an exposing device that outputs light to the photoconductive member, wherein the image scanning unit includes:

a casing having a pair of sidewalls;

a pair of carriage rails provided in parallel to each other along the sidewalls, each of the carriage rails including first and second rail sections parallel to each other and a vertical wall formed on a lower side of the second rail section;

a cross member suspended between the pair of carriage rails;

a carriage that moves in a longitudinal direction of the carriage rails;

a driving mechanism that moves the carriage along the carriage rails; and a coupling section that couples intermediate sections of the carriage rails to the sidewalls of the casing, the coupling section including a spacer member which is held between the vertical wall of the carriage rail and the sidewall of the casing.

10. The apparatus according to claim 9, wherein a fastening surface for fixing the cross member is provided in the intermediate sections in the longitudinal direction of the carriage rails, and the coupling section is provided in a position corresponding to the fastening surface.

11. The apparatus according to claim 9, wherein the spacer member includes:

a first sidewall section fixed to the carriage rails in a closely attached state;

a second sidewall section fixed to the sidewalls of the casing in a closely attached state; and a coupling wall that connects the first and second sidewall sections.

12. The apparatus according to claim 9, wherein the spacer member includes:

a first arm section fixed to the carriage rails;

a second arm section fixed to the sidewalls of the casing; and a connecting section that connects the first and second arm sections, and the spacer member is formed in a substantially Z shape viewed from above.

13. The apparatus according to claim 9, wherein when a distance between surfaces on inner sides of the pair of sidewalls of the casing is represented as W1, a distance between surfaces on outer sides of the pair of carriage rails coupled by the cross member is represented as W2, and thickness of the spacer member is represented as T, thickness 2×T equivalent to a pair of the spacer members is equal to a difference between the distance W1 and the distance W2, one spacer member is closely attached to one carriage rail and one sidewall of the casing, and the other spacer member is closely attached to the other carriage rail and the other sidewall of the casing.

14. The apparatus according to claim 9, wherein an imaging optical system including a lens and a CCD sensor is mounted on the cross member, and the spacer member is provided in a range from the imaging optical system to a terminal end of a scanning effective region in a region in which the carriage moves in a scanning direction.

15. The apparatus according to claim 9, wherein, in the coupling section, the intermediate sections in the longitudinal direction of the carriage rails and the sidewalls of the casing are directly fixed to each other by a fixing member.

16. The apparatus according to claim 15, wherein an imaging optical system including a lens and a CCD sensor is mounted on the cross member, and the coupling section is provided in a range from the imaging optical system to a terminal end of a scanning effective region in a region in which the carriage moves in a scanning direction.

* * * * *